US005890941A

United States Patent [19]

Deckers et al.

[11] Patent Number: 5,890,941

[45] Date of Patent: Apr. 6, 1999

[54] METHOD OF MANUFACTURING A DISPENSER CATHODE

[75] Inventors: Jacobus A.J.M. Deckers, Eindhoven; Theodorus H. Weekers, Weert; Albert Manenschijn, Eindhoven; Franciscus M.M. Snijkers, Eindhoven; Petrus A.M. Van Der Heide, Eindhoven, all of Netherlands

[73] Assignee: U.S. Philips Corporation, New York, N.Y.

[21] Appl. No.: 824,025

[22] Filed: Mar. 25, 1997

Related U.S. Application Data

[62] Division of Ser. No. 726,900, Oct. 7, 1996, Pat. No. 5,666,022, which is a continuation of Ser. No. 326,613, Oct. 19, 1994, abandoned.

[30] Foreign Application Priority Data

Oct. 28, 1993 [BE] Belgium ..... 09301155
Oct. 28, 1993 [BE] Belgium ..... 09301156

[51] Int. Cl.[6] ..... H01J 9/04
[52] U.S. Cl. ..... 445/51
[58] Field of Search ..... 445/50, 51

[56] References Cited

U.S. PATENT DOCUMENTS 4,274,030 6/1981 Buxbaum ..... 313/346 R
4,400,648 8/1983 Taguchi et al. ..... 313/346 R
4,436,651 3/1984 Corneille ..... 313/346 R
4,518,890 5/1985 Taguchi et al. ..... 313/346 R
5,006,753 4/1991 Hasker et al. ..... 445/51
5,096,450 3/1992 Sugimura et al. ..... 445/50
5,348,919 9/1994 Kuwabara et al. ..... 423/349 X

*Primary Examiner*—Kenneth J. Ramsey
*Attorney, Agent, or Firm*—Robert J. Kraus

[57] ABSTRACT

A method of manufacturing a dispenser cathode, in which method a powder of a refractory metal and a scandium-containing powder are mixed with each other and pressed to form a cathode body. According to the invention at least both these powders and a suitable binder are mixed with each other to form a homogeneous suspension prior to the pressing operation and the whole mixture is subsequently cured and ground to granules having a larger average size and hence a greater fluidity than the grains of the starting powders. Subsequently the granules thus obtained are pressed to form a cathode body (2). The invention leads to a better processibility and greater convenience of handling of the starting powders so that notably very fine staring powders can be used, which results in cathodes (1) having a better recovery after ion bombardment as compared with cathodes manufactured in conventional manners which are necessarily based on relatively coarse powders.

17 Claims, 1 Drawing Sheet

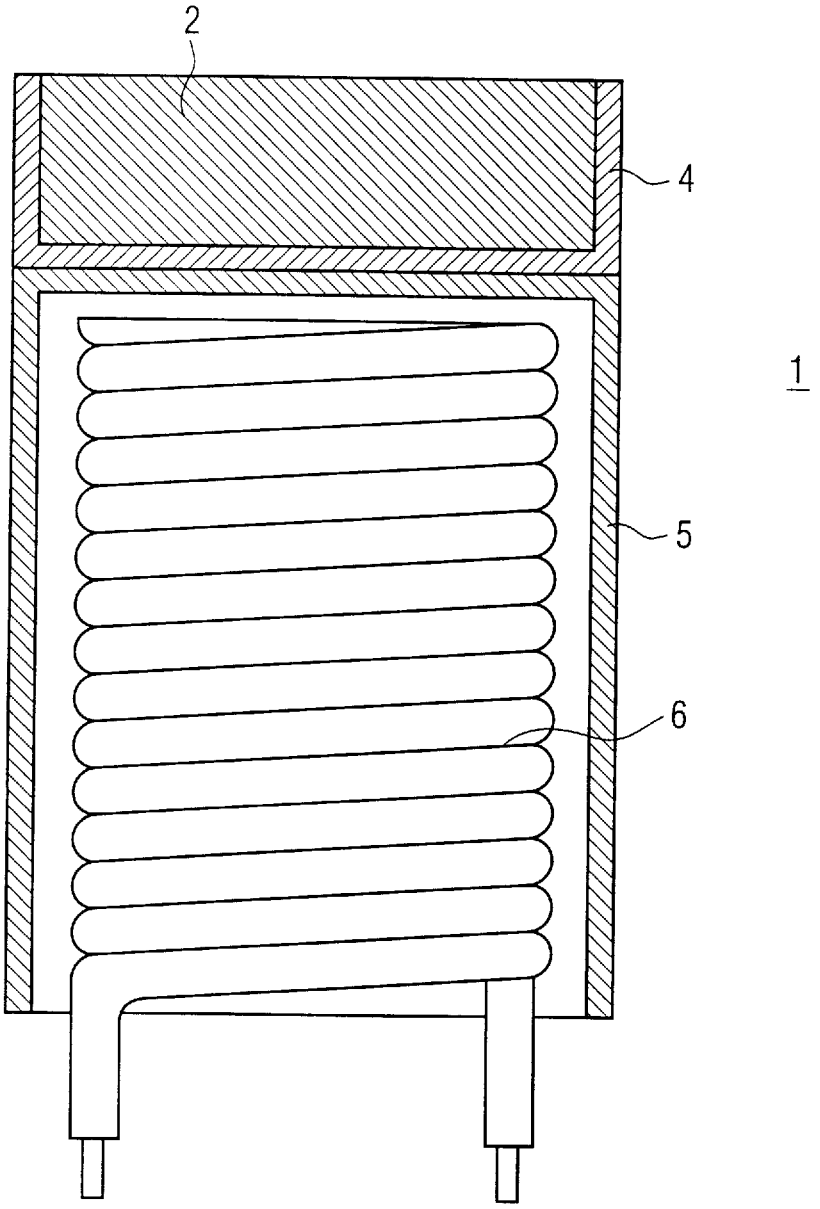
2
4
1
5
6

METHOD OF MANUFACTURING A DISPENSER CATHODE

This is a division of application Ser. No. 08/726,900, filed Oct. 7, 1996 U.S. Pat. No. 5,666,022, which is a continuation of application Ser. No. 08/326,613 filed Oct. 19, 1994 now abandoned.

BACKGROUND OF THE INVENTION

The invention relates to a dispenser cathode having a cathode body which comprises at least a refractory metal and a rare earth metal-containing material, and to a method of manufacturing a dispenser cathode, in which method a powder of a refractory metal and a rare earth metal-containing powder, in particular a scandium-containing powder, are mixed with each other and formed into a cathode body, while the cathode body is also provided with a barium-containing component.

In this context, the term "rare earth metal" is not limited to the lanthanides, but also includes, for example, yttrium and scandium.

Such a method is known from European Patent Application no. 298558 laid open to public inspection. In the method described in said document, a refractory metal in the form of tungsten powder and a scandium-containing powder comprising pure scandium or scandium hydride are mixed with each other in a ratio of 95:5 percent by weight, whereafter the powder mixture is compressed and sintered to form a cathode body which consists of mainly porous tungsten in which the scandium has been distributed. The cathode body is further provided with a barium-containing component by impregnating the cathode body at an elevated temperature with molten barium calcium aluminate to incorporate an electron emissive material.

Such a cathode is generally referred to as mixed-matrix scandate cathode and comprises a porous matrix mainly consisting of the refractory metal in which oxidized scandium (scandate) is distributed, while the barium-containing component, which usually has an oxidized form, is present in the pores of the matrix.

The oxidized states of scandium and of barium will hereinafter be referred to as scandium oxide and barium oxide, respectively, without exclusively indicating purely stoichiometric compounds, unless explicitly stated. The oxidized states may comprise, for example hybrid forms of stoichiometric oxides, viz. mixed oxides.

The barium-containing component ensures that a mono-atomic layer comprising barium is formed on the emissive surface of the cathode. The barium oxide is then reduced to barium by the matrix metal. Due to the mono-atomic top layer, the work function of free electrons in the matrix is sufficiently decreased to render electron emission possible. Since the mono-atomic top layer continuously loses barium due to the inevitable evaporation of barium, barium is, however, to be dispensed continuously so as to maintain the layer, which accounts for the name of such a cathode. Barium is dispensed in that, during operation, barium oxide which is reduced or not reduced diffuses from the pores to the emissive surface where it replenishes the mono-atomic layer.

In a mixed matrix scandate cathode the electron work function is further reduced in that not only barium but also scandium is present in the mono-atomic top layer. Such a cathode thus has an extremely high efficiency so that a comparatively strong electron emission can be realised already at relatively low temperatures. For example, with a cathode of the type described in the opening paragraph an electron emission of more than 100 A/cm$^2$ can be realised at a heating temperature of approximately 1000° C., which corresponds to an efficiency which is more than a factor of 10 higher than that of a dispenser cathode which does not comprise scandate. A cathode of the type described in the opening paragraph is therefore eminently suitable for use in an electron vacuum tube, particularly in a display tube in which a picture is imaged on a display screen by means of an electron beam generated by the cathode, or in a camera tube in which image information is read from a target plate by means of an electron beam generated by the cathode.

A problem which may occur in practice in the manufacture of such a cathode is that it is difficult to mix the starting powders. The scandium-containing material and the refractory metal often tend to demix. In addition, particularly very fine powders, i.e. powders having a very small average grain size appear to have the tendency of sticking together, which contributes to a poor mixability of the powders but also leads to poor handling and difficult processing.

SUMMARY OF THE INVENTION

It is an object of the invention to provide a method of the type described in the opening paragraph in which this problem is obviated.

According to the invention, a method of the type described in the opening paragraph is therefore characterized in that the two powders and a suitable binder are mixed with one another, in that the whole mixture is cured and ground to granules having a larger average size than the grains of the starting powders and in that the granules are subsequently pressed to form a cathode body.

The powder mixture is bound to a viscous mass with the aid of the binder such as particularly an acrylic resin dissolved in acetone, in which mass the powders are suspended homogeneously. This mass is cured, while binder solvent, if any, is removed. By grinding the resultant cured cake to granules which, on average, have a considerably larger size than the grains of the starting powders, a granule powder is obtained which has a considerably larger fluidity than the starting powders and which, in contrast to the relatively fine starting powders, flows easily and can therefore be handled and processed more easily. More particularly, the inventive method of pressing the cathode body starts from granules having an average grain size of more than approximately 50 $\mu$m.

In contrast to the grains of the starting powder, the granules generally do not contain any pure material but material of both the one and the other starting powder. Both materials, i.e. the refractory metal and the scandium-containing material are homogeneously mixed by means of the binder and thus also distributed uniformly across the granules and are ultimately present in the cathode body to a sufficiently homogeneous extent. In contrast to the grain sizes of the starting powders, the granule size in itself does not play a role as regards the uniformity of distributing the different components across the cathode body.

The invention notably provides the possibility of using extremely fine starting powders for the manufacture of the cathode. A particular embodiment of the method according to the invention is therefore characterized in that a powder having an average grain size of less than 1 $\mu$m is used as a starting material for the refractory metal, and in that the average grain size of the scandium-containing powder is less than 10 $\mu$m. Thus, an extremely homogeneous distribution of the two starting powders across the cathode body can be achieved.

It has been found that such fine starting powders result in a cathode having an improved recovery after ion bombardment, as compared with conventional cathodes which have been manufactured on the basis of starting powders necessarily consisting of considerably larger grains in connection with the convenience of handling the powders. Starting powders of the refractory metal having an average grain size in the range between 1 μm and 5 μm also yield very good results.

The cathode body is also provided with a electron emissive material like a barium-containing component. Particularly if these fine powders are used as a starting material, such a barium-containing component is preferably added already to the powder mixture with which it is processed to granules in which not only the refractory metal and the scandium-containing material but also the barium-containing component are now distributed homogeneously. Contrary to the known method, the barium-containing component then need not be added in a molten state to a cathode body which has already been pressed in that case. This inhibits leaching of the scandium-containing component. In fact, many conventional scandium-containing materials such as, for example pure scandium, scandium oxide and scandium hydride, are found to dissolve, for example in molten barium calcium aluminate.

It has also been found that the presence of the barium-containing component, such as particularly a barium calcium aluminate, has an inhibitive effect on the mutual sintering of the refractory metal and the scandium-containing material, if the barium-containing component has been added prior to the sintering process. Such a sintering process is generally performed after the cathode body has been pressed. It has been found that the sintering time and the sintering temperature decrease dramatically as the average grain sizes in the starting powders are chosen to be smaller. Consequently, the sintering process is difficult to control when very fine starting powders are used and there may be an unwanted continuation of this sintering process, even at the operating temperature of the cathode, unless the barium-containing component is added prior to the sintering operation in conformity with this special embodiment of the method according to the invention.

The emissive surface of the cathodes thus obtained can be advantageously provided with a rhenium-containing coating whose thickness ranges between 0.05 μm and 5 μm. This coating results in a further improvement of the dispensation. In operation, coatings having a thickness below 0.5 μm are too rapidly sputtered away whereas coatings having a thickness in excess of 5 μm block the pores of the cathode body. In practice, a thickness between 0.1 μm and 0.5 μm is chosen.

These and other aspects of the invention will be apparent from and elucidated with reference to the embodiments described hereinafter.

BRIEF DESCRIPTION OF THE DRAWING

The drawing shows a dispenser cathode 1 manufactured by means of the method according to the invention. The drawing is purely diagrammatic and not to scale. For the sake of clarity, some dimensions are strongly exaggerated.

DESCRIPTION OF THE PREFERRED EMBODIMENT

For the manufacture of a dispenser cathode a refractory metal in the form of tungsten powder and of a scandium-containing powder comprising scandium oxide are mixed with each other to form a homogeneous mixture. Instead of scandium oxide, the starting material may alternatively be, for example pure scandium powder or scandium hydride powder or scandium nitride powder and, instead of tungsten another refractory metal such as, for example rhenium or molybdenum or a mixture of refractory metal powders may be used. According to the invention, the starting material is tungsten powder whose average grain size is smaller than 1 μm (i.e. half of the grains have a thickness of 1 μm or less; ($d_{50}$=1 μm)) and scandium oxide powder having an average grain size of less than 10 μm, and the two powders are mixed to a homogeneous powder mixture in a ratio of approximately 97:3 percent by weight. In the present example, the average grain size of the tungsten powder is between 0.2 and 0.5 am and the scandium oxide grains have an average grain size of between 0.5 μm and 1 μm. The final cathode body preferably comprises between 0.5 and 2 wt. % of scandium-containing particles. If the cathode body comprises 0.5 wt. % of scandium-containing particles having an average diameter of 10 μm, a density of $10^7$ particles/$cm^3$ is obtained. If the cathode body comprises 2 wt. % of scandium-containing particles having an average diameter of 0.2 μm, a density of $5\times10^{12}$ particles/$cm^3$ is obtained.

The tungsten powder and the scandium oxide powder are further mixed with a suitable barium-containing component such as, in this example, a pulverulent barium calcium aluminate, for example barium oxide (BaO), aluminium oxide ($Al_2O_3$) and calcium oxide (CaO) in a ratio of 4:1:1 mol percent.

Subsequently, a suitable organic binder is added to the powder mixture in the form of 0.3–3% by weight of acrylic resin dissolved in acetone so as to bind the whole mixture to a viscous mass. Subsequently, the whole mixture is dried at an elevated temperature so as to remove the acetone from the binder. The cured cake thus obtained is ground to granules, whereafter the material obtained is sieved with a sieve having openings with a diameter of approximately 200 μm. A powder of granules having a size ranging mainly between 50 and 200 μm is thus obtained. Such a granule powder has a considerably larger fluidity than the ultrafine starting powders and thus flows considerably more easily than the tungsten and scandium oxide powders which have been used as starting materials. Consequently, the granule powder can be processed much more easily. Moreover, the granulation prevents the tungsten and scandium oxide from demixing in later process steps, which is also due to the mutually different grain sizes and widely divergent specific masses. Like the barium calcium aluminate, the tungsten and scandium oxide are homogeneously distributed across the granules.

Within the scope of the invention, the notion of grinding should be considered to have a wide meaning so that it is not only understood to mean grinding by means of a (ball) mill but, for example also grinding in a mortar and pulverising or crumbling in other ways.

The granule powder is introduced into a mould in which one or more pellets are pressed at a high pressure from the powder by means of a die, which pellets have a diameter of approximately 1 mm and a porosity of approximately 20–30% and are subsequently sintered for a short period at a temperature of between 1400° C. and 1900° C. The presence of the barium calcium aluminate in the granules has an inhibitive effect on the sintering process so that this process can be more easily controlled. For the very fine starting powders of the present example and without the presence of the barium calcium aluminate, the sintering process would proceed at such a low temperature and so rapidly that the method is poorly reproducible. However, since as in the present example the barium-containing component is already present in the cathode body prior to the sintering process, all this is adequately obviated.

In another example, the starting material was a tungsten power, half the particles of which had a diameter of 2 μm or less ($d_{50}$=2 μm); recovery after the ion bombardment took place even more rapidly. Mixtures in which half of the tungsten grains had a diameter of 50 μm or less ($d_{50}$=5 μm) also led to satisfactory results. The grain size of the metal particles (tungsten) in the finished product is governed by the size of the particles in the starting powder.

The sintered cathode body 2 is introduced into a suitable holder 4 of a refractory metal, in this example of molybdenum, see the drawing figures. The holder is welded onto a cathode shaft 5 which is also made of molybdenum and accommodates a filament 6 with which the cathode can be brought to the desired operating temperature. The cathode body may alternatively be mounted in the holder first and then sintered. Subsequently, the complete cathode and other parts are assembled to form a cathode ray tube.

Although the invention has been described with reference to the embodiment explained hereinbefore, it will be evident that the invention is certainly not limited to this embodiment and that those skilled in the art will be able to conceive many modifications without departing from the scope of the invention.

For example, instead of tungsten powder, the starting material may be a powder of a different refractory metal such as, for example molybdenum or a powder of several refractory metals. Moreover, the cathode body may not entirely be manufactured in accordance with the method as described hereinbefore, but comprise a supporting body of a suitable metal, for example molybdenum or tungsten which is provided with a top layer manufactured in accordance with the invention. Such a cathode is usually referred to as top layer cathode. A wire cathode can also be manufactured in this manner. The cathode body may further not be pressed in a die but directly in the cathode holder in which it is subsequently sintered.

If desired, the barium-containing component such as, for example a barium calcium aluminate, may alternatively be added in a molten state to a cathode body which has meanwhile been pressed. The molten barium calcium aluminate will be absorbed in a capillary manner by the cathode body in this case so that the cathode body will ultimately be soaked by the aluminate. Since many scandium-containing materials dissolve in molten barium calcium aluminate and will thus be leached during impregnation, it is preferable to start from a powder having an average grain size of more than 1 μm as regards the scandium-containing material, so as to ensure that sufficient scandium-containing material is left behind in the cathode body.

On the other hand, it has been found that the use of a binder is not strictly necessary when very fine tungsten grains are used.

As mentioned. hereinabove, the dispensation can be further accelerated by providing the surface with a rhenium coating or a rhenium-containing coating. Such a coating can also successfully be used in dispenser cathodes manufactured in a different manner.

Generally, the present invention provides a method of manufacturing a dispenser cathode which is more convenient to handle and in which the starting powders can be more easily processed so that notably very fine starting powders can be used, which leads to a cathode having an improved recovery after ion bombardment as compared with cathodes manufactured in conventional manners which are necessarily based on coarser starting powders.

We claim:

1. A method of manufacturing a dispenser cathode, in which method a powder of a refractory metal and a rare-earth metal containing powder are mixed with each other and formed into a cathode body, characterized in that the two powders and a suitable binder are mixed with one another, in that the whole mixture is cured and ground to granules having a larger average size than the grains of the starting powders and in that the granules are subsequently pressed to form a cathode body.

2. A method as claimed in claim 1 characterized in that granules having an average size of more than approximately 50 μm are used for pressing the cathode body.

3. A method as claimed in claim 2, characterized in that a powder of grains having an average grain size of less than 1 μm is used as a starting material for the refractory metal, and in that a powder of grains having an average grain size of less than 10 μm is used as a starting material for the rare earth metal-containing material.

4. A method as claimed in claim 2, characterized in that a barium-containing component is added to the powder mixture and said component is processed to granules together with the powder mixture.

5. A method as claimed in claim 1 characterized in that an acrylic resin is used as an organic binder.

6. A method as claimed in claim 5, characterized in that a barium-containing component is added to the powder mixture and said component is processed to granules together with the powder mixture.

7. A method as claimed in claim 1, characterized in that a powder of grains having an average grain size of less than 1 μm is used as a starting material for the refractory metal, and in that a powder of grains having an average grain size of less than 10 μm is used as a starting material for the rare earth metal-containing material.

8. A method as claimed in claim 7, characterized in that a barium-containing component is added to the powder mixture and said component is processed to granules together with the powder mixture.

9. A method as claimed in claim 1, characterized in that a barium-containing component is added to the powder mixture and said component is processed to granules together with the powder mixture.

10. A method as claimed in claim 9, characterized in that the barium-containing component comprises a pulverulent barium calcium aluminate powder.

11. A method as claimed in claim 1, characterized in that a metal from a group of tungsten, rhenium and molybdenum is chosen as the powder of the refractory metal.

12. A method of manufacturing a dispenser cathode, in which method a powder of a refractory metal and a scandium-containing powder are mixed with each other and formed into a cathode body, characterized in that the two powders and a suitable binder are mixed with one another, in that the whole mixture is cured and ground to granules having a larger average size than the grains of the starting powders and in that the granules are subsequently pressed to form a cathode body.

13. A method as claimed in claim 12, characterized in that granules having an average size of more than approximately 50 μm are used for pressing the cathode body.

14. A method as claimed in claim 12, characterized in that an acrylic resin is used as an organic binder.

15. A method as claimed in claim 12, characterized in that a powder of grains having an average grain size of less than 1 μm is used as a starting material for the refractory metal, and in that a powder of grains having an average grain size of less than 10 μm is used as a starting material for the rare earth metal-containing material.

16. A method as claimed in claim 12, characterized in that a barium-containing component is added to the powder mixture and said component is processed to granules together with the powder mixture.

17. A method of manufacturing a dispenser cathode, in which method a powder of a refractory metal and scandium-containing powder are mixed with each other and formed into a cathode body, while the cathode body is also provided with a barium-containing component, characterized in that a powder or grains having an average grain size or less than 1 μm is used as a starting material for the refractory metal, and in that a powder of grains having an average grain size or less than 10 μm is used as a starting material for the scandium-containing material.

* * * * *